US009359824B2

(12) United States Patent
Thigpen et al.

(10) Patent No.: US 9,359,824 B2
(45) Date of Patent: Jun. 7, 2016

(54) METHOD FOR REDUCING INTERMETALLIC COMPOUNDS IN MATRIX BIT BONDLINE

(71) Applicant: Varel Europe S.A.S., Pau (FR)

(72) Inventors: Gary M. Thigpen, Houston, TX (US); Federico Bellin, Tomball, TX (US); Marvin Windsor Amundsen, Houston, TX (US); Olivier Ther, Paris (FR); Alfazazi Dourfaye, Paris (FR); Bruno Cuillier De Maindreville, Pau (FR); Williams Gomez, Bazet (FR)

(73) Assignee: VAREL EUROPE S.A.S., Pau (FR)

( * ) Notice: Subject to any disclaimer, the term of this patent is extended or adjusted under 35 U.S.C. 154(b) by 214 days.

(21) Appl. No.: 14/162,501

(22) Filed: Jan. 23, 2014

(65) Prior Publication Data

US 2014/0131115 A1 May 15, 2014

Related U.S. Application Data

(63) Continuation-in-part of application No. 13/476,662, filed on May 21, 2012, now Pat. No. 8,973,683.

(60) Provisional application No. 61/489,056, filed on May 23, 2011.

(51) Int. Cl.

| | |
|---|---|
| ***E21B 10/54*** | (2006.01) |
| ***E21B 10/42*** | (2006.01) |
| ***B22D 19/06*** | (2006.01) |
| ***B22F 7/08*** | (2006.01) |
| ***C22C 29/08*** | (2006.01) |
| ***E21B 10/00*** | (2006.01) |
| *B22F 5/00* | (2006.01) |

(52) U.S. Cl.
CPC ..... *E21B 10/42* (2013.01); *B22D 19/06* (2013.01); *B22F 7/08* (2013.01); *C22C 29/08* (2013.01); *E21B 10/00* (2013.01); *B22F 2005/001* (2013.01)

(58) Field of Classification Search
CPC ..... E21B 7/08; E21B 10/402; E21B 10/54; E21B 10/55; E21B 10/60
See application file for complete search history.

(56) References Cited

U.S. PATENT DOCUMENTS

| | | | |
|---|---|---|---|
| 6,287,360 | B1 | 9/2001 | Kembaiyan |
| 2008/0282618 | A1 | 11/2008 | Lockwood |

(Continued)

FOREIGN PATENT DOCUMENTS

| | | | |
|---|---|---|---|
| DE | 29918960 | * | 4/2000 |
| WO | 9813159 | | 4/1998 |

(Continued)

*Primary Examiner* — William P Neuder

(57) ABSTRACT

An apparatus and method for manufacturing a downhole tool that reduces failures occurring along a bondline between a cemented matrix coupled around a blank. The cemented matrix material is formed from a tungsten carbide powder, a shoulder powder, and a binder material, wherein at least one of the tungsten carbide powder or the shoulder powder is absent of any free tungsten. The blank, which optionally may be coated, is substantially cylindrically shaped and defines a channel extending from a top portion and through a bottom portion of the blank. The absence of free tungsten from at least one of the tungsten carbide powder or the shoulder powder reduces the reaction with iron from the blank, thereby allowing the control and reduction of intermetallic compounds thickness within the bondline.

30 Claims, 8 Drawing Sheets

(56) References Cited

U.S. PATENT DOCUMENTS

| | | | | |
|---|---|---|---|---|
| 2010/0206639 | A1 | 8/2010 | Lockwood | |
| 2011/0084420 | A1* | 4/2011 | Reese | B22D 19/14 264/219 |
| 2012/0298425 | A1 | 11/2012 | De Maindreville | |
| 2013/0092453 | A1* | 4/2013 | Johnson | E21B 10/42 175/428 |
| 2013/0312927 | A1 | 11/2013 | Thomas | |

FOREIGN PATENT DOCUMENTS

| | | |
|---|---|---|
| WO | 2008091793 | 7/2008 |
| WO | 2010078129 | 7/2010 |
| WO | 2011060406 | 5/2011 |

* cited by examiner

METHOD FOR REDUCING INTERMETALLIC COMPOUNDS IN MATRIX BIT BONDLINE

RELATED APPLICATIONS

The present application is a continuation-in-part of U.S. patent application Ser. No. 13/476,662, entitled "Heavy Duty Matrix Bit," and filed on May 21, 2012, which claims priority to U.S. Provisional Patent Application No. 61/489,056, entitled "Heavy Matrix Drill Bit" and filed on May 23, 2011, the disclosures of which are incorporated by reference herein.

BACKGROUND OF THE INVENTION

This invention relates generally to downhole tools and methods for manufacturing such items. More particularly, this invention relates to infiltrated matrix drilling products including, but not limited to, fixed cutter bits, polycrystalline diamond compact ("PDC") drill bits, natural diamond drill bits, thermally stable polycrystalline ("TSP") drill bits, bi-center bits, core bits, and matrix bodied reamers and stabilizers, and the methods of manufacturing such items.

Full hole tungsten carbide matrix drill bits for oilfield applications have been manufactured and used in drilling since at least as early as the 1940's. FIG. 1 shows a cross-sectional view of a downhole tool casting assembly 100 in accordance with the prior art. The downhole tool casting assembly 100 consists of a thick-walled mold 110, a stalk 120, one or more nozzle displacements 122, a blank 124, a funnel 140, and a binder pot 150. The downhole tool casting assembly 100 is used to fabricate a casting (not shown) of a downhole tool.

According to a typical downhole tool casting assembly 100, as shown in FIG. 1, and a method for using the downhole tool casting assembly 100, the thick-walled mold 110 is fabricated with a precisely machined interior surface 112, and forms a mold volume 114 located within the interior of the thick-walled mold 110. The thick-walled mold 110 is made from sand, hard carbon graphite, ceramic, or other known suitable materials. The precisely machined interior surface 112 has a shape that is a negative of what will become the facial features of the eventual bit face. The precisely machined interior surface 112 is milled and dressed to form the proper contours of the finished bit. Various types of cutters (not shown), known to persons having ordinary skill in the art, can be placed along the locations of the cutting edges of the bit and can also be optionally placed along the gage area of the bit. These cutters can be placed during the bit fabrication process or after the bit has been fabricated via brazing or other methods known to persons having ordinary skill in the art.

Once the thick-walled mold 110 is fabricated, displacements are placed at least partially within the mold volume 114 of the thick-walled mold 110. The displacements are typically fabricated from clay, sand, graphite, ceramic, or other known suitable materials. These displacements consist of the center stalk 120 and the at least one nozzle displacement 122. The center stalk 120 is positioned substantially within the center of the thick-walled mold 110 and suspended a desired distance from the bottom of the mold's interior surface 112. The nozzle displacements 122 are positioned within the thick-walled mold 110 and extend from the center stalk 120 to the bottom of the mold's interior surface 112. The center stalk 120 and the nozzle displacements 122 are later removed from the eventual drill bit casting so that drilling fluid (not shown) can flow though the center of the finished bit during the drill bit's operation.

The blank 124 is a cylindrical steel casting mandrel that is centrally suspended at least partially within the thick-walled mold 110 and around the center stalk 120. The blank 124 is positioned a predetermined distance down in the thick-walled mold 110. According to the prior art, the distance between the outer surface of the blank 124 and the interior surface 112 of the thick-walled mold 110 is typically twelve millimeters ("mm") or more so that potential cracking of the thick-walled mold 110 is reduced during the casting process.

Once the displacements 120, 122 and the blank 124 have been positioned within the thick-walled mold 110, tungsten carbide powder 130, which includes free tungsten, is loaded into the thick-walled mold 110 so that it fills a portion of the mold volume 114 that is around the lower portion of the blank 124, between the inner surfaces of the blank 124 and the outer surfaces of the center stalk 120, and between the nozzle displacements 122. Shoulder powder 134 is loaded on top of the tungsten carbide powder 130 in an area located at both the area outside of the blank 124 and the area between the blank 124 and the center stalk 120. The shoulder powder 134 is made of tungsten powder. This shoulder powder 134 acts to blend the casting to the steel blank 124 and is machinable. Once the tungsten carbide powder 130 and the shoulder powder 134 are loaded into the thick-walled mold 110, the thick-walled mold 110 is typically vibrated to improve the compaction of the tungsten carbide powder 130 and the shoulder powder 134. Although the thick-walled mold 110 is vibrated after the tungsten carbide powder 130 and the shoulder powder 134 are loaded into the thick-walled mold 110, the vibration of the thick-walled mold 110 can be done as an intermediate step before, during, and/or after the shoulder powder 134 is loaded on top of the tungsten carbide powder 130.

The funnel 140 is a graphite cylinder that forms a funnel volume 144 therein. The funnel 140 is coupled to the top portion of the thick-walled mold 110. A recess 142 is formed at the interior edge of the funnel 140, which facilitates the funnel 140 coupling to the upper portion of the thick-walled mold 110. Typically, the inside diameter of the thick-walled mold 110 is similar to the inside diameter of the funnel 140 once the funnel 140 and the thick-walled mold 110 are coupled together.

The binder pot 150 is a cylinder having a base 156 with an opening 158 located at the base 156, which extends through the base 156. The binder pot 150 also forms a binder pot volume 154 therein for holding a binder material 160. The binder pot 150 is coupled to the top portion of the funnel 140 via a recess 152 that is formed at the exterior edge of the binder pot 150. This recess 152 facilitates the binder pot 150 coupling to the upper portion of the funnel 140. Once the downhole tool casting assembly 100 has been assembled, a predetermined amount of binder material 160 is loaded into the binder pot volume 154. The typical binder material 160 is a copper alloy or other suitable known material. Although one example has been provided for setting up the downhole tool casting assembly 100, other examples can be used to form the downhole tool casting assembly 100.

The downhole tool casting assembly 100 is placed within a furnace (not shown) or other heating structure. The binder material 160 melts and flows into the tungsten carbide powder 130 through the opening 158 of the binder pot 150. In the furnace, the molten binder material 160 infiltrates the tungsten carbide powder 130 and the shoulder powder 134 to fill the interparticle spaces formed between adjacent particles of tungsten carbide powder 130 and between adjacent particles of shoulder powder 134. During this process, a substantial amount of binder material 160 is used so that it fills at least a substantial portion of the funnel volume 144. This excess binder material 160 in the funnel volume 144 supplies a downward force on the tungsten carbide powder 130 and the shoulder powder 134. Once the binder material 160 completely infiltrates the tungsten carbide powder 130 and the shoulder powder 134, the downhole tool casting assembly 100 is pulled from the furnace and is controllably cooled. Upon cooling, the binder material 160 solidifies and cements the particles of tungsten carbide powder 130 and the shoulder powder 134 together into a coherent integral mass 310 (FIG. 3). The binder material 160 also bonds this coherent integral mass 310 (FIG. 3) to the steel blank 124 thereby forming a bonding zone 190, which is formed along at least a chamfered zone area 198 of the steel blank 124 and a central zone area 199 of the steel blank 124. The coherent integral mass 310 (FIG. 3) and the blank 124 collectively form the matrix body bit 200 (FIG. 2), a portion of which is shown in FIGS. 2 and 3. Once cooled, the thick-walled mold 110 is broken away from the casting. The casting then undergoes finishing steps which are known to persons having ordinary skill in the art, including the addition of a threaded connection (not shown) coupled to the top portion of the blank 124. Although the matrix body bit 200 (FIG. 2) has been described to be formed using the process and equipment described above, the process and/or the equipment can be varied to still form the matrix body bit 200 (FIG. 2).

FIG. 2 shows a magnified cross-sectional view of the bonding zone 190 located at the chamfered zone area 198 (FIG. 1) within the matrix body bit 200 in accordance with the prior art. FIG. 3 shows a magnified cross-sectional view of the bonding zone 190 located at the central zone area 199 (FIG. 1) within the matrix body bit 200 in accordance with the prior art. Referring to FIGS. 2 and 3, the coherent integral mass 310 is bonded to the steel blank 124 via the bonding zone 190 that is formed along and/or adjacent the surface of the steel blank 124. The binder material 160 causes a portion of the iron from the steel blank 124 to diffuse into the binder material 160 and react with the free tungsten within the shoulder powder 134 and the tungsten carbide powder 130, thereby forming this bonding zone 190. The bonding zone 190 includes intermetallic compounds 290. These intermetallic compounds 290 have an average hardness level of about 250 HV, which corresponds to about twice the hardness of the binder and steel matrix. According to FIG. 2, the bonding zone 190 is formed having a thickness 215 ranging from about sixty-five micrometers (μm) to about eighty μm in the chamfered zone area 198 (FIG. 1). According to FIG. 3, the bonding zone 190 is formed having a thickness 315 ranging from about ten μm to about twenty μm in the central zone area 199 (FIG. 1). The thicknesses 215, 315 and/or volumes of the bonding zone 190 are dependent upon the exposure time and the exposure temperature. Exposure temperature is related to the type of binder material 160 that is used to cement the tungsten carbide particles to one another. Manufacturers typically use the same binder material 160 over long periods of time, such as ten year or more, because of the knowledge gained with respect to the binder material 160 used. Thus, the exposure temperature is substantially the same from one casting to another. Exposure time is not always the same, but instead, is related to the bit diameter that is to be manufactured. When the bit diameter to be manufactured is relatively large, there is a larger volume of tungsten carbide particles that are to be cemented to one another. Hence, the exposure time also is relatively longer, thereby providing more time for cementing the larger volume of tungsten carbide particles. Thus, since the exposure temperature is the same from one casting to another, and the exposure time is the same for casting similar bit diameters, it follows that the thicknesses 215, 315 of intermetallic compounds 290 formed within the bit is consistent from one casting to another for a same bit diameter.

Initially, natural diamond bits were used in oilfield applications. These natural diamond bits performed by grinding the rock within the wellbore, and not by shearing the rock. Thus, these natural diamond bits experienced little to no torque, and hence very little stress was experienced at the bonding zone 190 of the natural diamond bits. With the advent of PDC drill bits, the bits sheared the rock within the wellbore and began experiencing more torque. However, these initial PDC drill bits were fabricated relatively small, about six inch diameters to about 12¼ inch diameters, and the prior art fabrication method described above continued to perform well. Later, PDC drill bits were fabricated having larger diameters and failures began occurring along the bonding zone 190. Specifically, decohesion began occurring between the blank 124 and the coherent integral mass 310, or matrix, at the bonding zone 190. These intermetallic compounds 290 are a source for causing mechanical stresses to occur along the bonding zone 190 during drilling applications because there is a contraction of volume occurring when the intermetallic compounds 290 are formed. These intermetallic compounds are very brittle and some cracks in the intermetallic compounds could occur during the drilling process. These cracks could weaken the bit and lead to catastrophic failure. Now that cutter technology has improved, the demand placed upon the bits have also increased. Bits are being drilled for more hours. Bits also are being used with much more energy, which includes energy produced from increasing the weight on bit and/or from increasing the rotational speed of the bit. This increased demand on the bits is causing the decohesion failure to become a recurring problem in the industry. As the thickness or volume of the intermetallic compounds 290 increases, the risk of decohesion also increases.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

DETAILED DESCRIPTION OF THE INVENTION

This invention relates generally to downhole tools and methods for manufacturing such items. More particularly, this invention relates to infiltrated matrix drilling products including, but not limited to, fixed cutter bits, polycrystalline diamond compact ("PDC") drill bits, natural diamond drill bits, thermally stable polycrystalline ("TSP") drill bits, bi-center bits, core bits, and matrix bodied reamers and stabilizers, and the methods of manufacturing such items. Although the description provided below is related to a drill bit, embodiments of the present invention relate to any infiltrated matrix drilling product.

Figure 1:
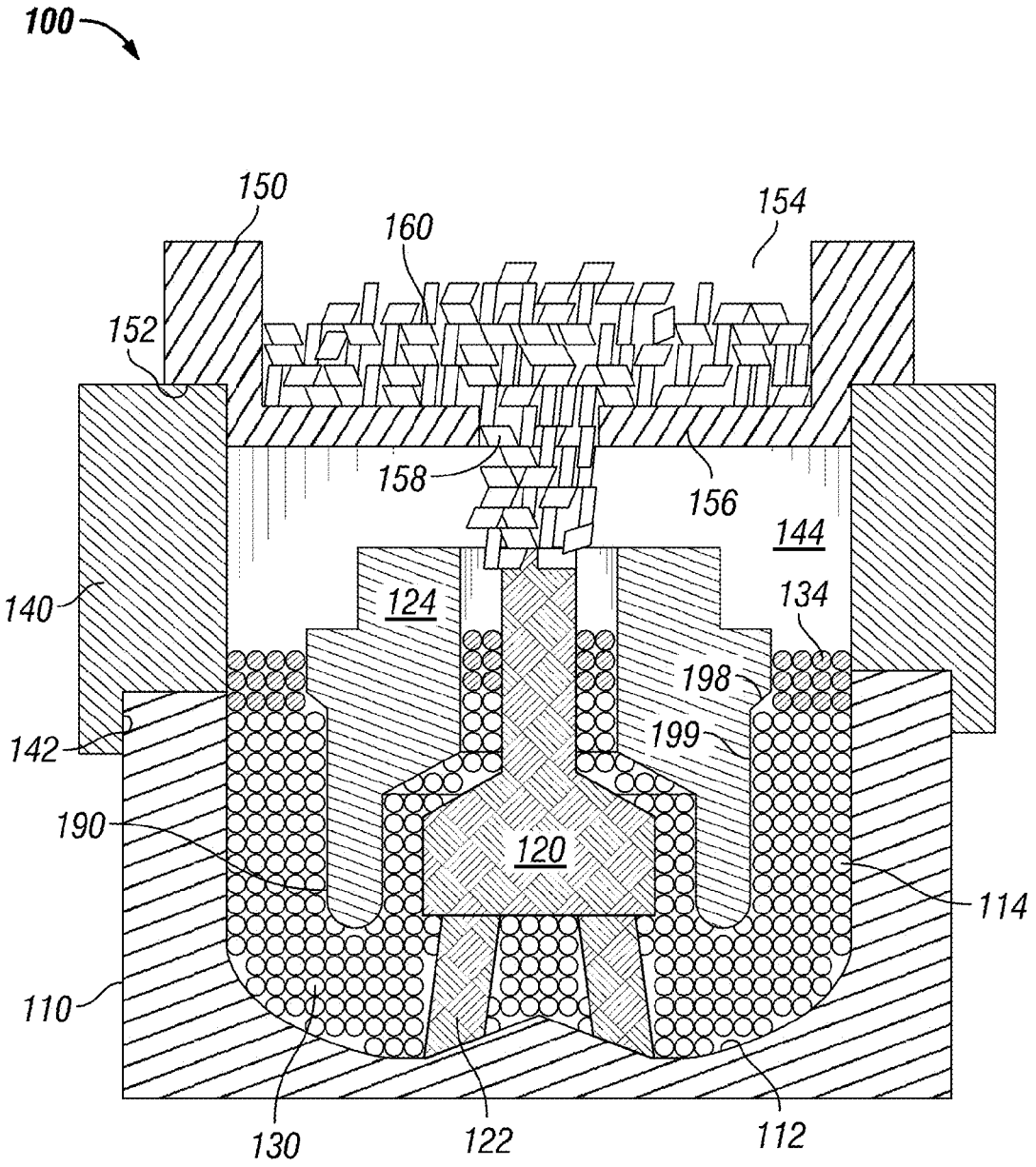
FIG. 1 (Prior Art)
FIG. 1 shows a cross-sectional view of a downhole tool casting assembly in accordance with the prior art.
Figure 4:
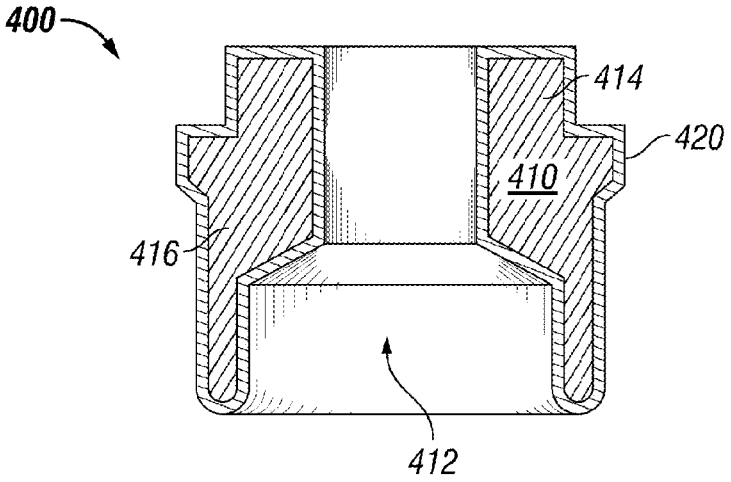
FIG. 4 shows a cross-sectional view of a blank in accordance with an exemplary embodiment.

FIG. 4 shows a cross-sectional view of a blank 400 in accordance with an exemplary embodiment. The blank 400 includes an internal blank component 410 and a metal coating 420 coupled around at least a portion of the surface of the internal blank component 410. The internal blank component 410 is similar to the blank 124 (FIG. 1) above. The internal blank component 410 is a cylindrically, hollow-shaped component and includes a cavity 412 extending through the entire length of the internal blank component 410. According to some exemplary embodiments the internal blank component 410 also includes a top portion 414 and a bottom portion 416. The top portion 414 has a smaller outer circumference than the bottom portion 416. According to some exemplary embodiments, the internal blank component 410 is fabricated from steel; however, any other suitable material known to people having ordinary skill in the art is used in other exemplary embodiments.

The metal coating 420 is applied onto at least a portion of the surface of the internal blank component 410. In some exemplary embodiments, the metal coating 420 is applied onto the surface of the entire internal blank component 410. In other exemplary embodiments, the metal coating 420 is applied onto a portion of the surface of the internal blank component 410. For example, the metal coating 420 is applied onto the surface of the bottom portion 416, which is the portion that bonds to the matrix material, or a coherent integral mass 710 (FIG. 7), which is described below. The metal coating 420 is applied onto the internal blank component 410 using electroplating techniques. Alternatively, other techniques, such as plasma spray, ion bombardment, electrochemical depositing, laser cladding, cold spray, or other known coating techniques, are used to apply the metal coating 420 onto the internal blank component 410 in other exemplary embodiments. The metal coating 420 is fabricated using a material that reduces the formation of intermetallic compounds 690 (FIG. 6) along and/or adjacent the surface of the blank 400 (FIG. 4). Specifically, the metal coating 420 reduces the migration of iron from the internal blank component 410 into the binder material 560 (FIG. 5) for reacting with the free tungsten at the temperature and exposure time during the fabrication process. The metal coating 420 is fabricated from nickel according to some exemplary embodiments. Alternatively, the metal coating 420 is fabricated using at least one of brass, bronze, copper, aluminum, zinc, cobalt, titanium, gold, refractory transitional materials such as molybdenum and tantalum, carbide, boride, oxide, metal matrix composites, a metal alloy of any previously mentioned metals, or any other suitable material that is capable of reducing the migration of iron from the internal blank component 410 into the binder material 560 (FIG. 5) for reacting with the free tungsten. Alternatively, a different type of coating, such as a polymer coating, is used in lieu of the metal coating.

The metal coating 420 is applied onto the internal blank component 410 and has a thickness 422 ranging from about five μm to about 200 μm. In another exemplary embodiment, the metal coating 420 has a thickness 422 ranging from about five μm to about 150 μm. In yet another exemplary embodiment, the metal coating 420 has a thickness 422 ranging from about five μm to about eighty μm. In a further exemplary embodiment, the metal coating 420 has a thickness 422 ranging less than or greater than the previously mentioned ranges. In certain exemplary embodiments, the thickness 422 is substantially uniform, while in other exemplary embodiments, the thickness 422 is non-uniform. For example, the thickness 422 is greater along the surface of the internal blank component 410 that would typically form a greater thickness of the intermetallic compound during the fabrication process, such as the chamfered zone area 598 (FIG. 5).

Figure 5:
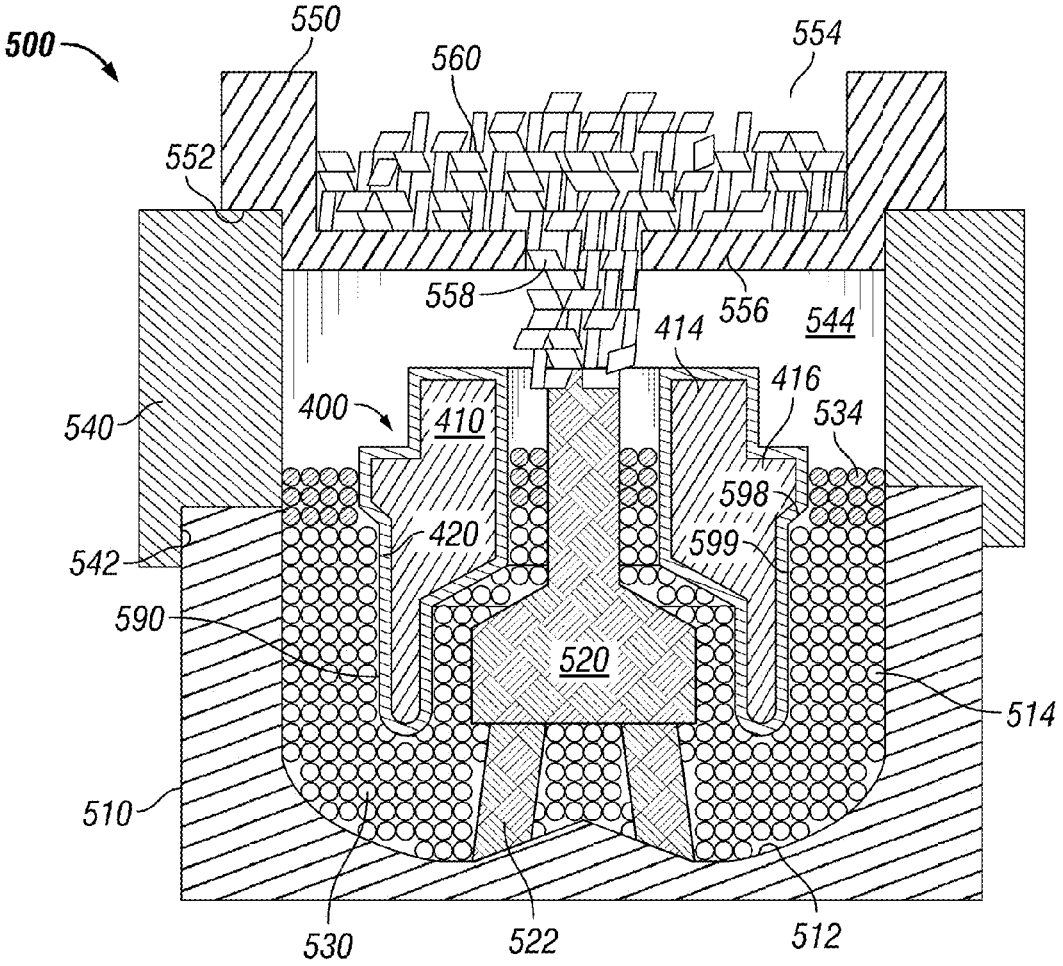
FIG. 5 shows a cross-sectional view of a downhole tool casting assembly using the blank of FIG. 4 in accordance with the exemplary embodiment.

FIG. 5 shows a cross-sectional view of a downhole tool casting assembly 500 using the blank 400 in accordance with the exemplary embodiment. Referring to FIG. 5, the downhole tool casting assembly 500 includes a mold 510, a stalk 520, one or more nozzle displacements 522, the blank 400, a funnel 540, and a binder pot 550. The downhole tool casting assembly 500 is used to fabricate a casting (not shown) of a downhole tool, such as a fixed cutter bit, a PDC drill bit, a natural diamond drill bit, and a TSP drill bit. However, the downhole tool casting assembly 500 is modified in other exemplary embodiments to fabricate other downhole tools, such as a bi-center bit, a core bit, and a matrix bodied reamer and stabilizer.

The mold 510 is fabricated with a precisely machined interior surface 512, and forms a mold volume 514 located within the interior of the mold 510. The mold 510 is made from sand, hard carbon graphite, ceramic, or other known suitable materials. The precisely machined interior surface 512 has a shape that is a negative of what will become the facial features of the eventual bit face. The precisely machined interior surface 512 is milled and dressed to form the proper contours of the finished bit. Various types of cutters (not shown), known to persons having ordinary skill in the art, are placed along the locations of the cutting edges of the bit and are optionally placed along the gage area of the bit. These cutters are placed during the bit fabrication process or after the bit has been fabricated via brazing or other methods known to persons having ordinary skill in the art.

Once the mold 510 is fabricated, displacements are placed at least partially within the mold volume 514. The displacements are fabricated from clay, sand, graphite, ceramic, or other known suitable materials. These displacements include the center stalk 520 and the at least one nozzle displacement 522. The center stalk 520 is positioned substantially within the center of the mold 510 and suspended a desired distance from the bottom of the mold's interior surface 512. The nozzle displacements 522 are positioned within the mold 110 and extend from the center stalk 520 to the bottom of the mold's interior surface 512. The center stalk 520 and the nozzle displacements 522 are later removed from the eventual drill bit casting so that drilling fluid (not shown) flows though the center of the finished bit during the drill bit's operation.

The blank 400, which has been previously described above, is centrally suspended at least partially within the mold 510 and around the center stalk 520. The blank 400 is positioned a predetermined distance down in the mold 510. The distance between the outer surface of the blank 400 and the interior surface 512 of the mold 510 is about twelve millimeters or more so that potential cracking of the mold 510 is reduced during the casting process. However, this distance is varied in other exemplary embodiments depending upon the strength of the mold 510 or the method and/or equipment used in fabricating the casting.

Once the displacements 520, 522 and the blank 400 have been positioned within the mold 510, tungsten carbide powder 530 is loaded into the mold 110 so that it fills a portion of the mold volume 514 that is around the bottom portion 416 of the blank 400, between the inner surfaces of the blank 400 and the outer surfaces of the center stalk 520, and between the nozzle displacements 522. Shoulder powder 534 is loaded on top of the tungsten carbide powder 530 in an area located at both the area outside of the blank 400 and the area between the blank 400 and the center stalk 520. The shoulder powder 534 is made of tungsten powder or other known suitable material. This shoulder powder 534 acts to blend the casting to the blank 400 and is machinable. Once the tungsten carbide powder 530 and the shoulder powder 534 are loaded into the mold 510, the mold 510 is vibrated, in some exemplary embodiments, to improve the compaction of the tungsten carbide powder 530 and the shoulder powder 534. Although the mold 510 is vibrated after the tungsten carbide powder 530 and the shoulder powder 534 are loaded into the mold 510, the vibration of the mold 510 is done as an intermediate step before, during, and/or after the shoulder powder 534 is loaded on top of the tungsten carbide powder 530. Although tungsten carbide material 530 is used in certain exemplary embodiments, other suitable materials known to persons having ordinary skill in the art is used in alternative exemplary embodiments.

The funnel 540 is a graphite cylinder that forms a funnel volume 544 therein. The funnel 540 is coupled to the top portion of the mold 510. A recess 542 is formed at the interior edge of the funnel 540, which facilitates the funnel 540 coupling to the upper portion of the mold 510. In some exemplary embodiments, the inside diameter of the mold 510 is similar to the inside diameter of the funnel 540 once the funnel 540 and the mold 510 are coupled together.

The binder pot 550 is a cylinder having a base 556 with an opening 558 located at the base 556, which extends through the base 556. The binder pot 550 also forms a binder pot volume 554 therein for holding a binder material 560. The binder pot 550 is coupled to the top portion of the funnel 540 via a recess 152 that is formed at the exterior edge of the binder pot 550. This recess 552 facilitates the binder pot 550 coupling to the upper portion of the funnel 540. Once the downhole tool casting assembly 500 has been assembled, a predetermined amount of binder material 560 is loaded into the binder pot volume 554. The typical binder material 560 is a copper alloy or other suitable known material. Although one example has been provided for setting up the downhole tool casting assembly 500, other examples having greater, fewer, or different components are used to form the downhole tool casting assembly 500. For instance, the mold 510 and the funnel 540 are combined into a single component in some exemplary embodiments.

Figure 6:
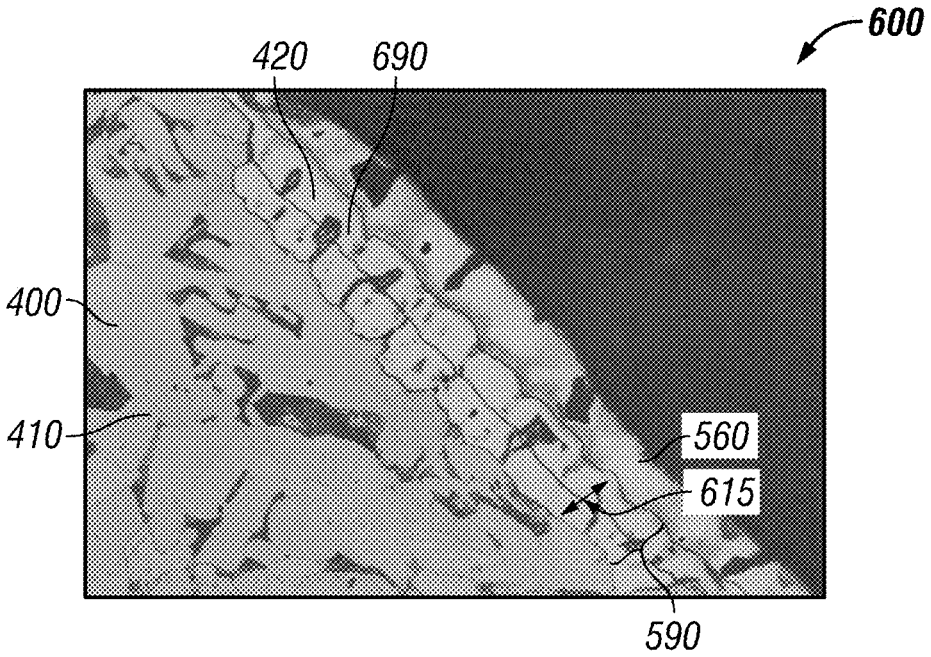
FIG. 6 shows a magnified cross-sectional view of a bonding zone located at a chamfered zone area within the downhole tool in accordance with the exemplary embodiment.
Figure 7:
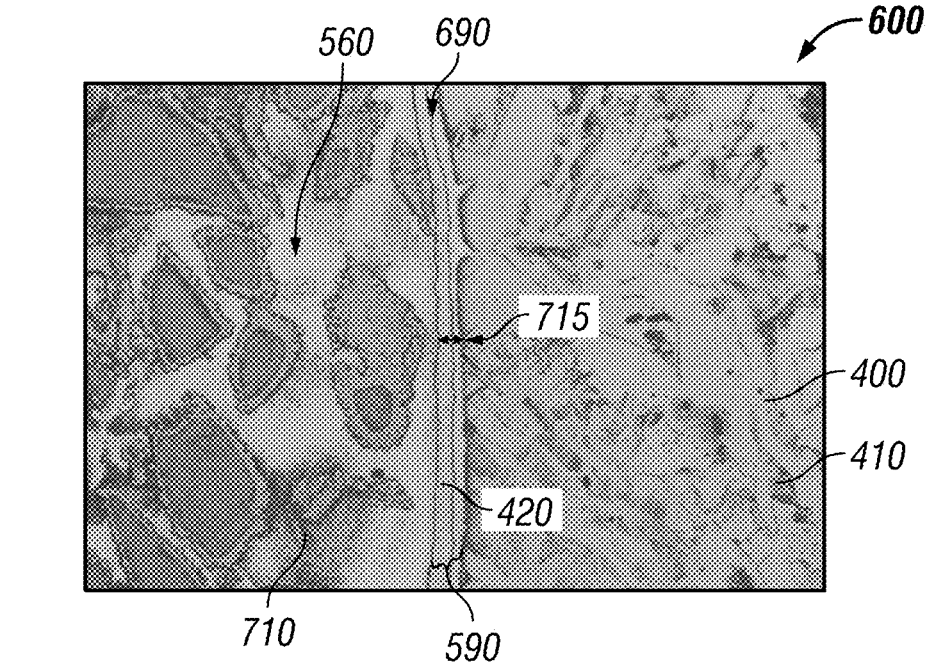
FIG. 7 shows a magnified cross-sectional view of a bonding zone located at a central zone area within the downhole tool in accordance with the exemplary embodiment.

The downhole tool casting assembly 500 is placed within a furnace (not shown) or other heating structure. The binder material 560 melts and flows into the tungsten carbide powder 530 through the opening 558 of the binder pot 550. In the furnace, the molten binder material 560 infiltrates the tungsten carbide powder 530 to fill the interparticle space formed between adjacent particles of tungsten carbide powder 530. During this process, a substantial amount of binder material 560 is used so that it fills at least a substantial portion of the funnel volume 544. This excess binder material 560 in the funnel volume 544 supplies a downward force on the tungsten carbide powder 530 and the shoulder powder 534. Once the binder material 560 completely infiltrates the tungsten carbide powder 530, the downhole tool casting assembly 500 is pulled from the furnace and is controllably cooled. Upon cooling, the binder material 560 solidifies and cements the particles of tungsten carbide powder 530 together into a coherent integral mass 710 (FIG. 7). The binder material 560 also bonds this coherent integral mass 710 (FIG. 7) to the blank 400 thereby forming a bonding zone 590, which is formed at least at a chamfered zone area 598 of the blank 400 and a central zone area 599 of the blank 400, according to certain exemplary embodiments. The coherent integral mass 710 (FIG. 7) and the blank 400 collectively form the matrix body bit 600 (FIG. 6), a portion of which is shown in FIGS. 6 and 7. Once cooled, the mold 510 is broken away from the casting. The casting then undergoes finishing steps which are known to persons of ordinary skill in the art, including the addition of a threaded connection (not shown) coupled to the top portion 414 of the blank 400. Although the matrix body bit 600 (FIG. 6) has been described to be formed using the process and equipment described above, the process and/or the equipment can be varied to still form the matrix body bit 600 (FIG. 6).

Figure 2:
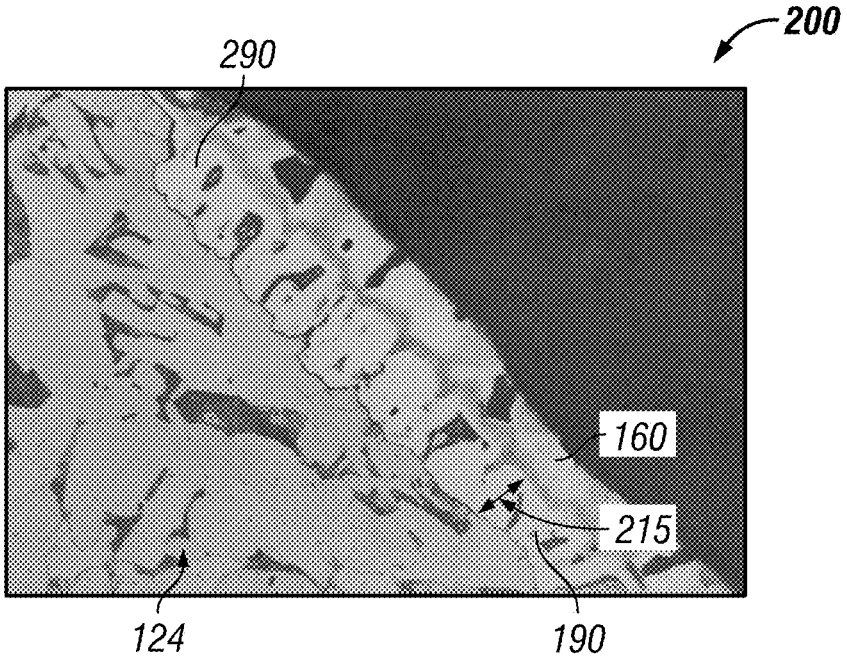
FIG. 2 (Prior Art)
FIG. 2 shows a magnified cross-sectional view of a bonding zone located at a chamfered zone area within the matrix body bit in accordance with the prior art.
Figure 3:
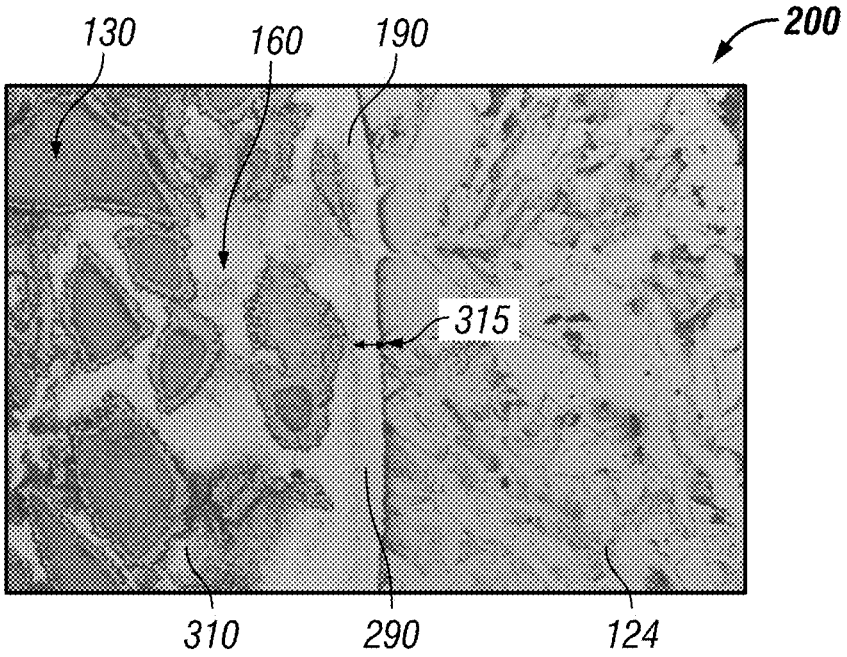
FIG. 3 (Prior Art)
FIG. 3 shows a magnified cross-sectional view of a bonding zone located at a central zone area within the matrix body bit in accordance with the prior art.

FIG. 6 shows a magnified cross-sectional view of the bonding zone 590 located at the chamfered zone area 598 (FIG. 5) within the downhole tool in accordance with the exemplary embodiment. FIG. 7 shows a magnified cross-sectional view of the bonding zone 590 located at the central zone area 599 (FIG. 5) within the downhole tool in accordance with the exemplary embodiment. Referring to FIGS. 6 and 7, the blank 400 includes the internal blank component 410 and the metal coating 420, which is applied onto the surface of the internal blank component 410. The coherent integral mass 710 is bonded to the blank 400 via the bonding zone 590 that is formed along and/or adjacent the surface of the blank 400. According to some exemplary embodiments, the metal coating 420 is thinly applied onto the internal blank component 410 so that a portion of the iron from the blank 400 to diffuses into the binder material 560 and reacts with the free tungsten within the shoulder powder 534 and the tungsten carbide powder 530, thereby forming this bonding zone 590. The bonding zone 590 includes intermetallic compounds 690, which are similar to the intermetallic compounds 290 (FIG. 2). According to FIG. 6, the bonding zone 590 is formed having a thickness 615 ranging from about five μm to less than sixty-five μm in the chamfered zone area 598 (FIG. 5). In another exemplary embodiment, the bonding zone 590 is formed having a thickness 615 ranging from about five μm to less than fifty μm in the chamfered zone area 598 (FIG. 5). In yet another exemplary embodiment, the bonding zone 590 is formed having a thickness 615 ranging from about five μm to less than thirty μm in the chamfered zone area 598 (FIG. 5).

According to FIG. 7, the bonding zone 590 is formed having a thickness 715 ranging from about two μm to less than about ten μm in the central zone area 599 (FIG. 5). In another exemplary embodiment, the bonding zone 590 is formed having a thickness 715 ranging from about two μm to less than eight μm in the central zone area 599 (FIG. 5). In yet another exemplary embodiment, the bonding zone 590 is formed having a thickness 715 ranging from about two μm to less than six μm in the central zone area 599 (FIG. 5). The thicknesses 615, 715 and/or volumes of the bonding zone 590 are dependent upon the exposure time, the temperature, and the thickness of the metal coating 420 that is applied onto the internal blank component 410. As previously mentioned, the metal coating 420 reduces the migration of iron from the blank 400 into the binder material 560, thereby decreasing the reaction with the free tungsten within the shoulder powder 534 and the tungsten carbide powder 530 during the fabrication process.

Figure 8:
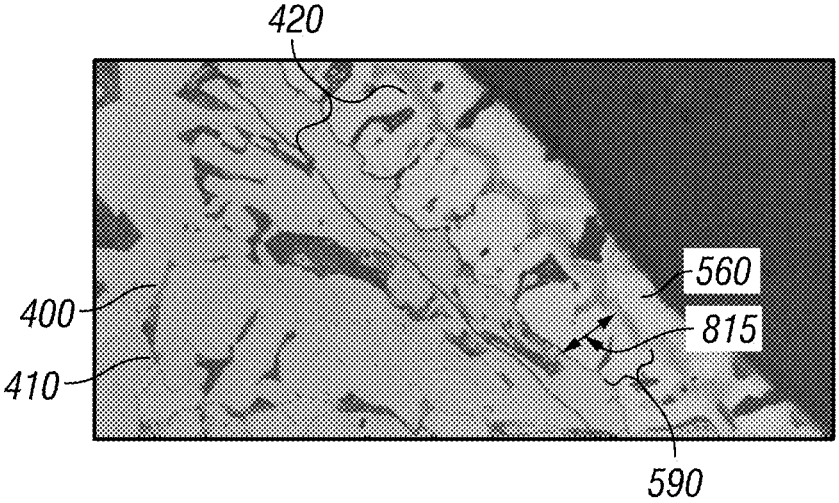
FIG. 8 shows a magnified cross-sectional view of a bonding zone located at a chamfered zone area within the downhole tool in accordance with another exemplary embodiment.
Figure 9:
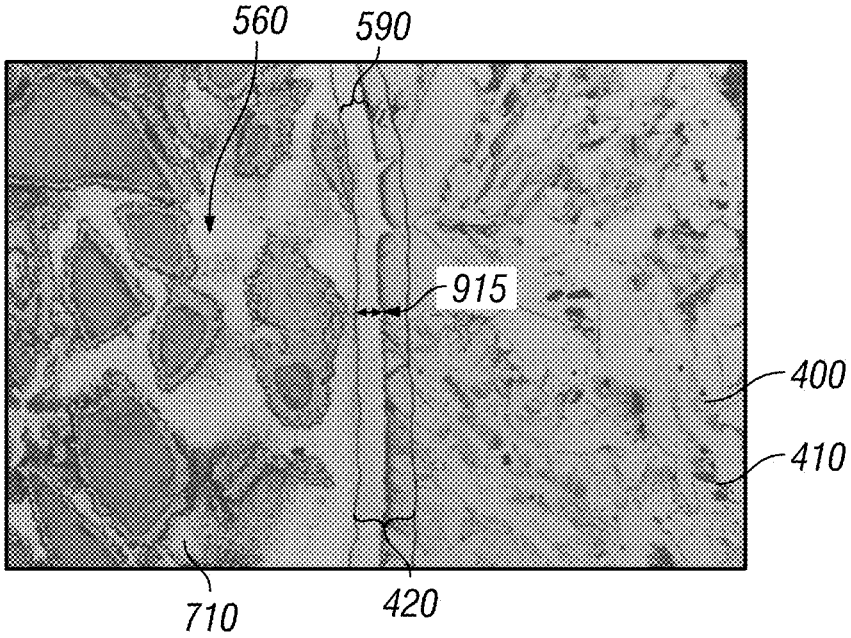
FIG. 9 shows a magnified cross-sectional view of a bonding zone located at a central zone area within the downhole tool in accordance with another exemplary embodiment.

FIG. 8 shows a magnified cross-sectional view of the bonding zone 590 located at the chamfered zone area 598 (FIG. 5) within the downhole tool in accordance with another exemplary embodiment. FIG. 9 shows a magnified cross-sectional view of the bonding zone 590 located at the central zone area 599 (FIG. 5) within the downhole tool in accordance with another exemplary embodiment. Referring to FIGS. 8 and 9, the blank 400 includes the internal blank component 410 and the metal coating 420, which is applied onto the surface of the internal blank component 410. The coherent integral mass 710 is bonded to the blank 400 via the bonding zone 590 that is formed along and/or adjacent the surface of the blank 400. According to some exemplary embodiments, the metal coating 420 is applied onto the internal blank component 410 such that a smaller portion of the iron from the blank 400 diffuses into the binder material 560. The diffused iron reacts with the free tungsten within the tungsten carbide powder 530 and the tungsten powder 534 to form this bonding zone 590. The bonding zone 590 includes intermetallic compounds 690, which are similar to the intermetallic compounds 290 (FIG. 2). According to FIG. 8, the bonding zone 590 is formed having a thickness 815 ranging from about five μm to less than sixty-five μm in the chamfered zone area 598 (FIG. 5). In another exemplary embodiment, the bonding zone 590 is formed having a thickness 815 ranging from about five μm to less than fifty μm in the chamfered zone area 598 (FIG. 5). In yet another exemplary embodiment, the bonding zone 590 is formed having a thickness 815 ranging from about five μm to less than thirty μm in the chamfered zone area 598 (FIG. 5). According to FIG. 9, the bonding zone 590 is formed having a thickness 915 ranging from about two μm to less than about ten μm in the central zone area 599 (FIG. 5). In another exemplary embodiment, the bonding zone 590 is formed having a thickness 915 ranging from about two μm to less than eight μm in the central zone area 599 (FIG. 5). In yet another exemplary embodiment, the bonding zone 590 is formed having a thickness 915 ranging from about two μm to less than six μm in the central zone area 599 (FIG. 5). The thicknesses 815, 915 and/or volumes of the bonding zone 590 are dependent upon the exposure time, the temperature, and the thickness of the metal coating 420 that is applied onto the internal blank component 410. As previously mentioned, the metal coating 420 reduces the migration of iron from the blank 400 into the binder material 560, thereby decreasing the reaction with the free tungsten within the shoulder powder 534 and the tungsten carbide powder 530 during the fabrication process.

Figure 10:
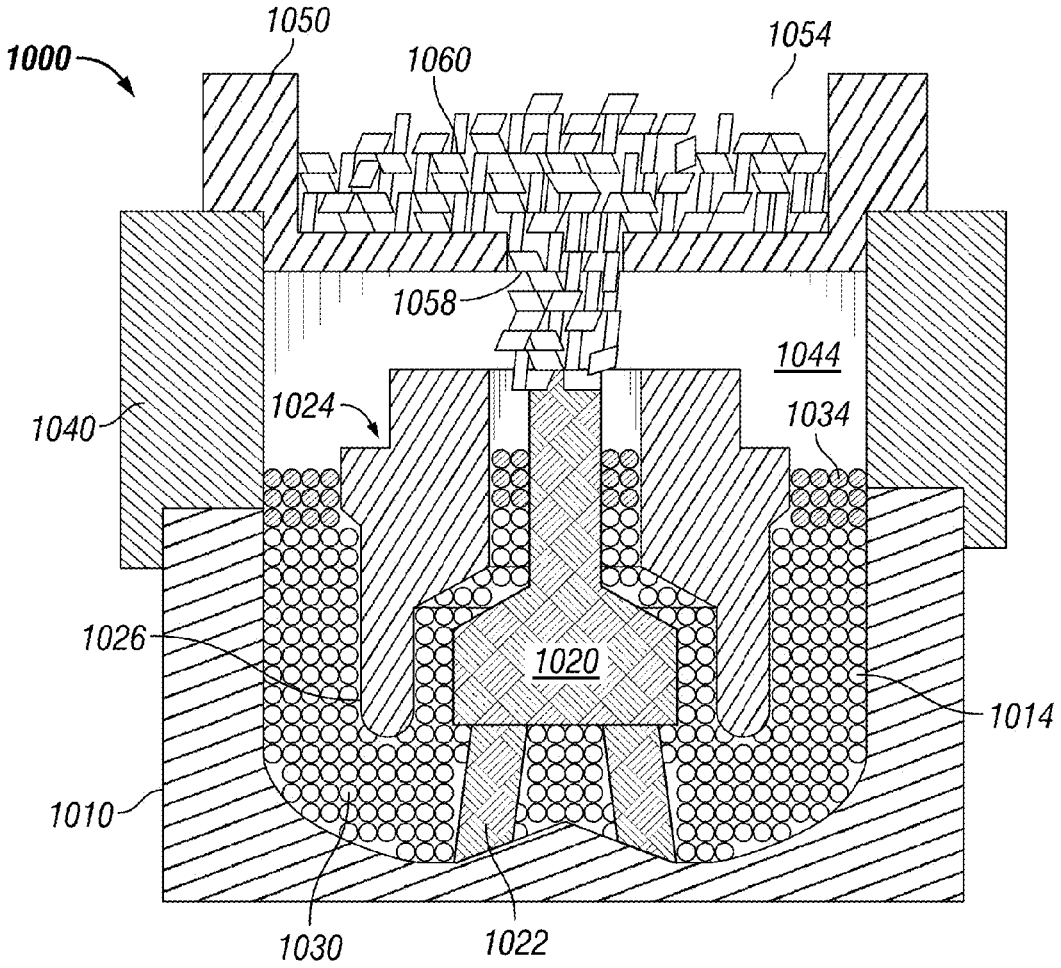
FIG. 10 shows a cross-sectional view of a downhole tool casting assembly in accordance with another exemplary embodiment.

FIG. 10 shows a cross-sectional view of a downhole tool casting assembly 1000 in accordance with another exemplary embodiment. Referring to FIG. 10, the downhole tool casting assembly 1000 includes a mold 1010, a stalk 1020, one or more nozzle displacements 1022, a blank 1024, a funnel 1040, and a binder pot 1050. The downhole tool casting assembly 1000 is used to fabricate a casting 1100 (FIG. 11) of a downhole tool, such as a fixed cutter bit, a PDC drill bit, a natural diamond drill bit, and a TSP drill bit. However, the downhole tool casting assembly 1000 is modified in other exemplary embodiments to fabricate other downhole tools, such as a bi-center bit, a core bit, and a matrix bodied reamer and stabilizer.

The mold 1010 is similar to mold 510 and forms a mold volume 1014, which is similar to mold volume 514. Since mold 510 has been previously described above, the details of mold 1010 are not repeated again herein for the sake of brevity. The center stalk 1020 and the one or more nozzle displacements 1022 are similar to the center stalk 520 and the nozzle displacements 522, respectively, and therefore the descriptions of each also are not repeated herein for the sake of brevity. Further, the blank 1024 used within the downhole tool casting assembly 1000 is similar to either the blank 124 (FIG. 1) or the blank 400 (FIG. 4) and therefore also is not repeated herein for the sake of brevity.

Figure 12:
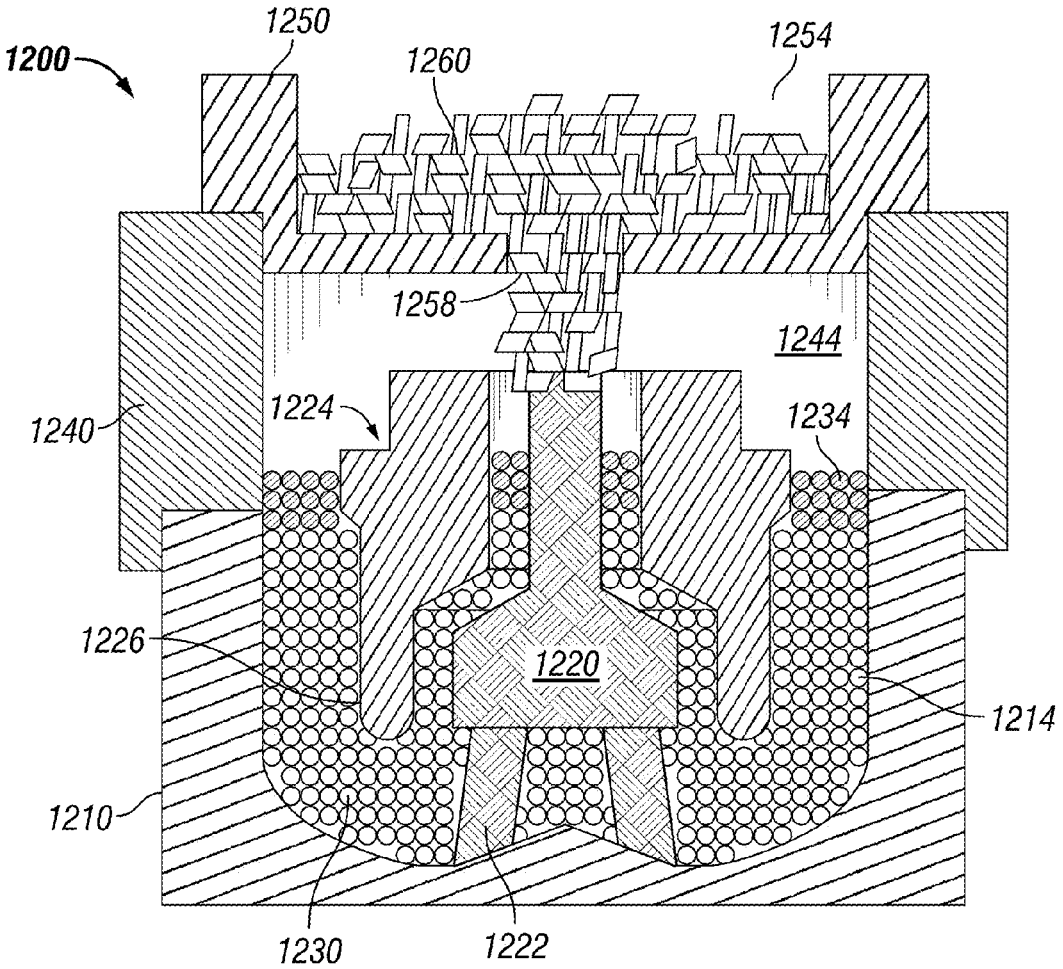
FIG. 12 shows a cross-sectional view of a downhole tool casting assembly in accordance with yet another exemplary embodiment.

Once the displacements 1020, 1022 and the blank 1024 have been positioned within the mold 1010, tungsten carbide powder 1030, similar to tungsten carbide powder 530, is loaded into the mold 1010 so that it fills a portion of the mold volume 1014 that is around the bottom portion 1026 of the blank 1024, between the inner surfaces of the blank 1024 and the outer surfaces of the center stalk 1020, and between the nozzle displacements 1022. According to the exemplary embodiment shown in FIG. 10, this tungsten carbide powder 1030 is the same as tungsten carbide powder 530 described above and includes at least $W_2C$ and some free tungsten. The process of fabricating $W_2C$ generally involves the inclusion of free tungsten. However, in other exemplary embodiments as shown in FIG. 12 for instance, this tungsten carbide powder 1030 is absent any free tungsten. Thus, the tungsten carbide powder 1030, which is absent any free tungsten, includes only WC in some exemplary embodiments. Alternatively, the tungsten carbide powder 1030, which is absent any free tungsten, includes $W_2C$, WC, or a combination of both, while excluding any free tungsten. Thus, any free tungsten is removed either during or after the fabricating process before placing the tungsten carbide powder 1030 within the mold 1010.

Shoulder powder 1034 is loaded on top of the tungsten carbide powder 1030 in an area located at both the area outside of the blank 1024 and the area between the blank 1024 and the center stalk 1020. The shoulder powder 1034 is made of stainless steel powder or other known suitable material that is absent any free tungsten. Some examples of other suitable materials that is usable for the shoulder powder 1034 include other steel powders, nickel powder, cobalt powder, refractory transitional materials such as molybdenum powder and tantalum powder, and/or other metals that have a higher melting temperature than the binder alloy material 1060 but are soft enough to be machined. This shoulder powder 1034 acts to blend the casting to the blank 1024 and is machinable. Once the tungsten carbide powder 1030 and the shoulder powder 1034 are loaded into the mold 1010, the mold 1010 is vibrated, in some exemplary embodiments, to improve the compaction of the tungsten carbide powder 1030 and the shoulder powder 1034. Although the mold 1010 is vibrated after the tungsten carbide powder 1030 and the shoulder powder 1034 are loaded into the mold 1010, the vibration of the mold 1010 is done as an intermediate step before, during, and/or after the shoulder powder 1034 is loaded on top of the tungsten carbide powder 1030. Although tungsten carbide material 1030 is used in certain exemplary embodiments, other suitable materials known to persons having ordinary skill in the art are used in alternative exemplary embodiments.

The funnel 1040 is similar to funnel 540 and forms a funnel volume 1044 therein, which is similar to funnel volume 544. Since funnel 540 has been previously described above, the details of funnel 1040 are not repeated again herein for the sake of brevity. Further, the binder pot 1050 is similar to binder pot 550 and forms a binder pot volume 1054 therein, which is similar to binder pot volume 554, for holding a binder material 1060, which is similar to binder material 560. Since binder pot 550 and binder material 560 have been previously described above, the details of binder pot 1050 and binder material 1060 are not repeated again herein for the sake of brevity. Although one example has been provided for setting up the downhole tool casting assembly 1000, other examples having greater, fewer, or different components are used to form the downhole tool casting assembly 1000. For instance, the mold 1010 and the funnel 1040 are combined into a single component in some exemplary embodiments.

Figure 11:
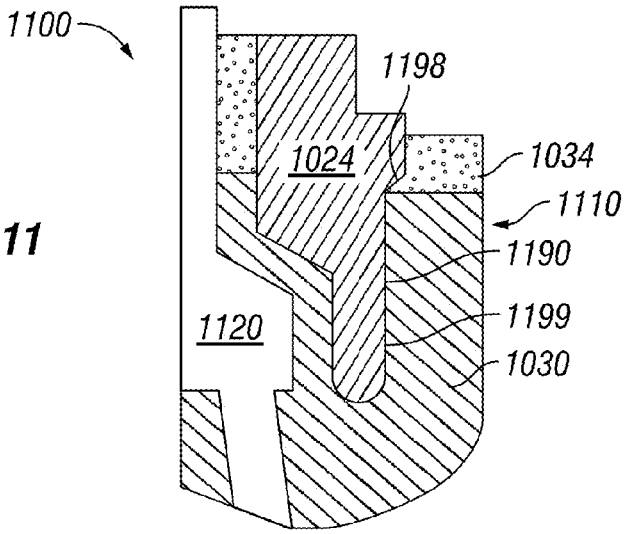
FIG. 11 shows a partial cross-sectional view of a downhole tool casting formed using the downhole tool casting assembly of FIG. 10 in accordance with the exemplary embodiment.

The downhole tool casting assembly 1000 is placed within a furnace (not shown) or other heating structure. The binder material 1060 melts and flows into the shoulder powder 1034 and the tungsten carbide powder 1030 through an opening 1058 of the binder pot 1050. In the furnace, the molten binder material 1060 infiltrates the shoulder powder 1034 and the tungsten carbide powder 1030 to fill the interparticle space formed between adjacent particles of the shoulder powder 1034 and the tungsten carbide powder 1030. During this process, a substantial amount of binder material 1060 is used so that it fills at least a substantial portion of the funnel volume 1044. This excess binder material 1060 in the funnel volume 1044 supplies a downward force on the tungsten carbide powder 1030 and the shoulder powder 1034. Once the binder material 1060 completely infiltrates the shoulder powder 1034 and the tungsten carbide powder 1030, the downhole tool casting assembly 1000 is pulled from the furnace and is controllably cooled. Upon cooling, the binder material 1060 solidifies and cements the particles of shoulder powder 1034 and tungsten carbide powder 1030 together into a coherent integral mass 1110 (FIG. 11). The binder material 1060 also bonds this coherent integral mass 1110 (FIG. 11) to the blank 1024 thereby forming a bonding zone 1190 (FIG. 11) therebetween. The coherent integral mass 1110 (FIG. 11) and the blank 1024 collectively form the casting 1100 (FIG. 11) or the matrix body bit 1100 (FIG. 11), a portion of which is shown in FIG. 11. Once cooled, the mold 1010 is broken away from the casting 1100 (FIG. 11). The casting 1100 (FIG. 11) then undergoes finishing steps which are known to persons of ordinary skill in the art, including the addition of a threaded connection (not shown) to the casting 1100 (FIG. 11). Although the casting 1100 (FIG. 11), or the matrix body bit 1100 (FIG. 11), has been described to be formed using the process and equipment described above, the process and/or the equipment can be varied to still form the matrix body bit 1100 (FIG. 11).

FIG. 11 shows a partial cross-sectional view of a downhole tool casting 1100 formed using the downhole tool casting assembly 1000 of FIG. 10 in accordance with the exemplary embodiment. Referring to FIG. 11, the downhole tool casting 1100 includes the coherent integral mass 1110, the blank 1024, and the passageways 1120 formed from the removal of the displacements 1020, 1022. As mentioned above with respect to FIG. 10, the coherent integral mass 1110 is formed using the tungsten carbide material 1030, as described above, and the shoulder powder 1034, also as described above. According to the exemplary embodiment illustrated in FIGS. 10 and 11, the shoulder powder 1034 is absent of free tungsten material and the tungsten carbide material 1030 is the same as tungsten carbide powder 530 described above and includes at least $W_2C$ and some free tungsten. However, in other exemplary embodiments as shown in FIG. 12 for instance, this tungsten carbide powder 1030 is absent any free tungsten. Thus, the tungsten carbide powder 1030, which is absent any free tungsten, includes only WC in some exemplary embodiments. Alternatively, the tungsten carbide powder 1030, which is absent any free tungsten, includes $W_2C$, WC, or a combination of both, while excluding any free tungsten.

The intermetallic compounds are formed when iron reacts with free tungsten. According to one of the present exemplary embodiments, the typical shoulder powder 134 having free tungsten is replaced with shoulder powder 1034, thereby reducing and/or eliminating the formation of these intermetallic compounds, which is very brittle. The shoulder powder 1034 occupies the area adjacent a chamfered portion 1198 of the blank 1024, similar to chamfered portion 598 (FIG. 5), which experiences high stresses. Thus, by reducing and/or eliminating these intermetallic compounds from that region, the casting or bit 1100 is more durable and has a greater longevity. According to alternative exemplary embodiments, a type of tungsten carbide powder 1030 which also is tungsten free may be used in place of the typical tungsten carbide powder 130, which includes free tungsten. The tungsten carbide powder 1030 occupies the area adjacent a central zone area 1199 of the blank 1024, similar to central zone area 599 (FIG. 5), which also experiences high stresses. Thus, by reducing and/or eliminating these intermetallic compounds from that region, the casting or bit 1100 is more durable and has a greater longevity. According to the exemplary embodiments, either or both shoulder powder 1034 and tungsten carbide powder 1030 (which are tungsten free) may be used in lieu of the typical shoulder powder 134 and typical tungsten carbide powder 130.

FIG. 12 shows a cross-sectional view of a downhole tool casting assembly 1200 in accordance with yet another exemplary embodiment. Referring to FIG. 12, the downhole tool casting assembly 1200 includes a mold 1210, a stalk 1220, one or more nozzle displacements 1222, a blank 1224, a funnel 1240, and a binder pot 1250. The downhole tool casting assembly 1200 is used to fabricate a casting 1300 (FIG. 13) of a downhole tool, such as a fixed cutter bit, a PDC drill bit, a natural diamond drill bit, and a TSP drill bit. However, the downhole tool casting assembly 1200 is modified in other exemplary embodiments to fabricate other downhole tools, such as a bi-center bit, a core bit, and a matrix bodied reamer and stabilizer.

The mold 1210 is similar to mold 510 and forms a mold volume 1214, which is similar to mold volume 514. Since mold 510 has been previously described above, the details of mold 1210 are not repeated again herein for the sake of brevity. The center stalk 1220 and the one or more nozzle displacements 1222 are similar to the center stalk 520 and the nozzle displacements 522, respectively, and therefore the descriptions of each also are not repeated herein for the sake of brevity. Further, the blank 1224 used within the downhole tool casting assembly 1200 is similar to either the blank 124 (FIG. 1) or the blank 400 (FIG. 4) and therefore also is not repeated herein for the sake of brevity.

Once the displacements 1220, 1222 and the blank 1224 have been positioned within the mold 1210, tungsten carbide powder 1230 is loaded into the mold 1210 so that it fills a portion of the mold volume 1214 that is around the bottom portion 1226 of the blank 1224, between the inner surfaces of the blank 1224 and the outer surfaces of the center stalk 1220, and between the nozzle displacements 1222. According to the exemplary embodiment shown in FIG. 12, this tungsten carbide powder 1230 is absent any free tungsten, and includes $W_2C$, WC, or a combination of both, while excluding any free tungsten. In certain exemplary embodiments, the tungsten carbide powder 1230, which is absent any free tungsten, includes only WC.

Shoulder powder 1234 is loaded on top of the tungsten carbide powder 1230 in an area located at both the area outside of the blank 1224 and the area between the blank 1224 and the center stalk 1220. The shoulder powder 1234 is tungsten powder according to some exemplary embodiments; however, in other exemplary embodiments the shoulder powder 1234 is made of stainless steel powder or other known suitable material that is absent any free tungsten. Some examples of other suitable materials that is usable for the shoulder powder 1234 include other steel powders, nickel powder, cobalt powder, and/or other metals that have a higher melting temperature than the binder alloy material 1260 but are soft enough to be machined. This shoulder powder 1234 acts to blend the casting to the blank 1224 and is machinable. Once the tungsten carbide powder 1230 and the shoulder powder 1234 are loaded into the mold 1210, the mold 1210 is vibrated, in some exemplary embodiments, to improve the compaction of the tungsten carbide powder 1230 and the shoulder powder 1234. Although the mold 1210 is vibrated after the tungsten carbide powder 1230 and the shoulder powder 1234 are loaded into the mold 1210, the vibration of the mold 1210 is done as an intermediate step before, during, and/or after the shoulder powder 1234 is loaded on top of the tungsten carbide powder 1230. Although tungsten carbide material 1230 is used in certain exemplary embodiments, other suitable materials known to persons having ordinary skill in the art are used in alternative exemplary embodiments.

The funnel 1240 is similar to funnel 540 and forms a funnel volume 1244 therein, which is similar to funnel volume 544. Since funnel 540 has been previously described above, the details of funnel 1240 are not repeated again herein for the sake of brevity. Further, the binder pot 1250 is similar to binder pot 550 and forms a binder pot volume 1254 therein, which is similar to binder pot volume 554, for holding a binder material 1260, which is similar to binder material 560. Since binder pot 550 and binder material 560 have been previously described above, the details of binder pot 1250 and binder material 1260 are not repeated again herein for the sake of brevity. Although one example has been provided for setting up the downhole tool casting assembly 1200, other examples having greater, fewer, or different components are used to form the downhole tool casting assembly 1200. For instance, the mold 1210 and the funnel 1240 are combined into a single component in some exemplary embodiments.

Figure 13:
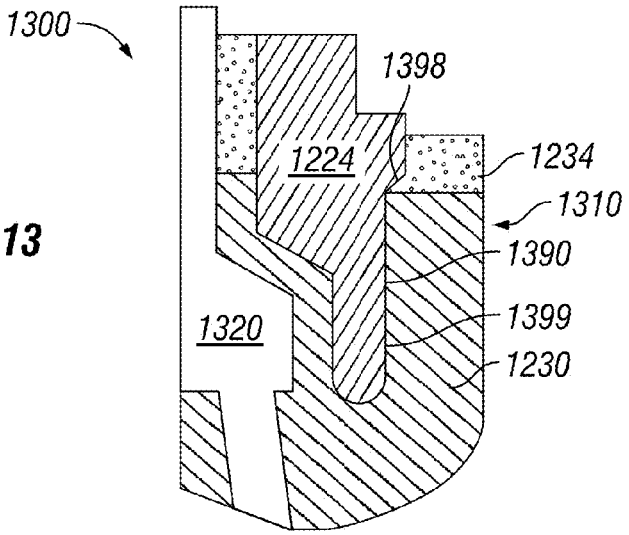
FIG. 13 shows a partial cross-sectional view of a downhole tool casting formed using the downhole tool casting assembly of FIG. 12 in accordance with the exemplary embodiment.

The downhole tool casting assembly 1200 is placed within a furnace (not shown) or other heating structure. The binder material 1260 melts and flows into the shoulder powder 1234 and the tungsten carbide powder 1230 through an opening 1258 of the binder pot 1250. In the furnace, the molten binder material 1260 infiltrates the shoulder powder 1234 and the tungsten carbide powder 1230 to fill the interparticle space formed between adjacent particles of the shoulder powder 1234 and the tungsten carbide powder 1230. During this process, a substantial amount of binder material 1260 is used so that it fills at least a substantial portion of the funnel volume 1244. This excess binder material 1260 in the funnel volume 1244 supplies a downward force on the tungsten carbide powder 1230 and the shoulder powder 1234. Once the binder material 1260 completely infiltrates the shoulder powder 1234 and the tungsten carbide powder 1230, the downhole tool casting assembly 1200 is pulled from the furnace and is controllably cooled. Upon cooling, the binder material 1260 solidifies and cements the particles of shoulder powder 1234 and tungsten carbide powder 1230 together into a coherent integral mass 1310 (FIG. 13). The binder material 1260 also bonds this coherent integral mass 1310 (FIG. 13) to the blank 1224 thereby forming a bonding zone 1390 (FIG. 13) therebetween. The coherent integral mass 1310 (FIG. 13) and the blank 1224 collectively form the casting 1300 (FIG. 13) or the matrix body bit 1300 (FIG. 13), a portion of which is shown in FIG. 13. Once cooled, the mold 1210 is broken away from the casting 1300 (FIG. 13). The casting 1300 (FIG. 13) then undergoes finishing steps which are known to persons of ordinary skill in the art, including the addition of a threaded connection (not shown) to the casting 1300 (FIG. 13). Although the casting 1300 (FIG. 13), or the matrix body bit 1300 (FIG. 13), has been described to be formed using the process and equipment described above, the process and/or the equipment can be varied to still form the matrix body bit 1300 (FIG. 13).

FIG. 13 shows a partial cross-sectional view of a downhole tool casting 1300 formed using the downhole tool casting assembly 1200 of FIG. 12 in accordance with the exemplary embodiment. Referring to FIG. 13, the downhole tool casting 1300 includes the coherent integral mass 1310, the blank 1224, and the passageways 1320 formed from the removal of the displacements 1220, 1222. As mentioned above with respect to FIG. 12, the coherent integral mass 1310 is formed using the tungsten carbide material 1230, as described above, and the shoulder powder 1234, also as described above. According to the exemplary embodiment illustrated in FIGS. 12 and 13, the shoulder powder 1234 includes tungsten powder and the tungsten carbide material 1030 is absent free tungsten and includes either WC, $W_2C$, or a combination of both. However, in other exemplary embodiments as shown in FIG. 12 for instance, this shoulder powder 1234 is absent any free tungsten. Thus, the shoulder powder 1234, which is absent any free tungsten, includes stainless steel powder or any other suitable material described above.

The intermetallic compounds are formed when iron reacts with free tungsten. According to one of the present exemplary embodiments, the typical tungsten carbide powder 130 having free tungsten is replaced with tungsten carbide powder 1230 which is absent of free tungsten, thereby reducing and/or eliminating the formation of these intermetallic compounds, which is very brittle. The tungsten carbide powder 1230 occupies the area adjacent a central zone area 1399 of the blank 1024, similar to central zone area 599 (FIG. 5), which experiences high stresses. Thus, by reducing and/or eliminating these intermetallic compounds from that region, the casting or bit 1300 is more durable and has a greater longevity. According to alternative exemplary embodiments, the shoulder powder 1234 which is tungsten free, according to some exemplary embodiments, may be used in place of the typical shoulder powder 134, which includes free tungsten. The shoulder powder 1234 occupies the area adjacent a chamfered portion 1398 of the blank 1224, similar to chamfered portion 598 (FIG. 5), which also experiences high stresses. Thus, by reducing and/or eliminating these intermetallic compounds from that region, the casting or bit 1300 is more durable and has a greater longevity. According to the exemplary embodiments, either or both shoulder powder 1234 and tungsten carbide powder 1230 (which are tungsten free) may be used in lieu of the typical shoulder powder 134 and typical tungsten carbide powder 130.

Figure 14:
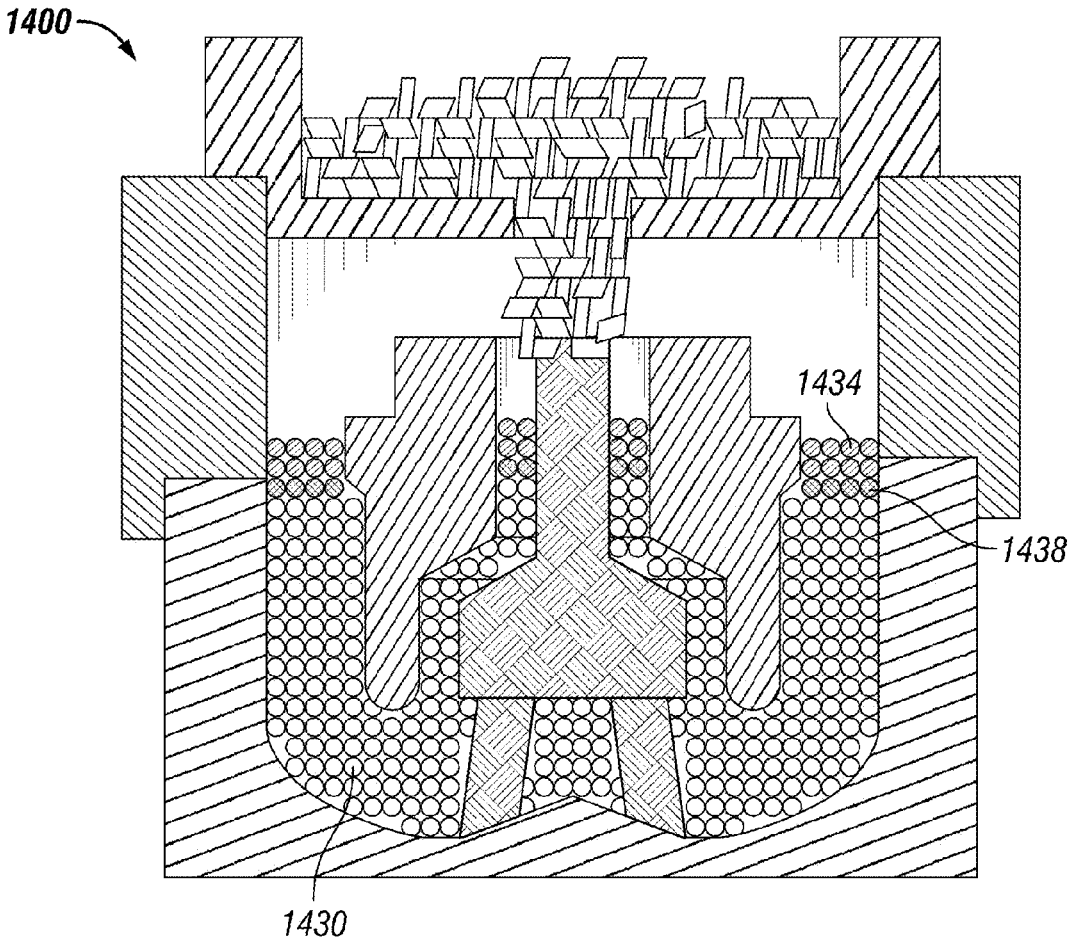
FIG. 14 shows a cross-sectional view of a downhole tool casting assembly in accordance with yet another exemplary embodiment.

FIG. 14 shows a cross-sectional view of a downhole tool casting assembly 1400 in accordance with yet another exemplary embodiment. The downhole casting assembly 1400 is similar to downhole casting assembly 1000 (FIG. 10) and/or downhole casting assembly 1200 (FIG. 12) except an intermediate layer 1438 is disposed between the shoulder powder 1434 and the tungsten carbide powder 1430. The intermediate layer 1438 is meant to minimize stresses caused by thermal expansion according to some exemplary embodiments. The shoulder powder 1434 is similar to shoulder powder 1034, 1234 (FIGS. 10 and 12, respectively) and the tungsten carbide powder 1430 is similar to tungsten carbide powder 1030, 1230 (FIGS. 10 and 12, respectively). At least one of the shoulder powder 1434 and the tungsten carbide powder 1430 is absent of free tungsten. The intermediate layer 1438 is formed by including an amount of tungsten carbide powder 1430 that is used to the shoulder powder 1434 that is used thereby transitioning from the tungsten carbide powder 1430 to the shoulder powder 1434. The amount of tungsten carbide powder 1430 that is included with the shoulder powder 1434 in the intermediate layer 1438 is about twenty percent to thirty percent by volume with respect to the shoulder powder 1434. According to some other exemplary embodiments, the amount of tungsten carbide powder 1430 that is included in the intermediate layer 1438 is between ten percent and less than fifty percent by volume. According to certain exemplary embodiments, the composition of the intermediate layer 1438 gradually varies from the bottom of the intermediate layer 1438 to the top of the intermediate layer 1438, where the composition at the bottom of the intermediate layer 1438 is close to the composition of the tungsten carbide powder 1430 and the composition at the top of the intermediate layer 1438 is close to the composition of the shoulder powder 1434. This intermediate layer 1438 is harder than the areas where the shoulder powder 1434 is, but is still machinable according to certain exemplary embodiments.

Figure 15:
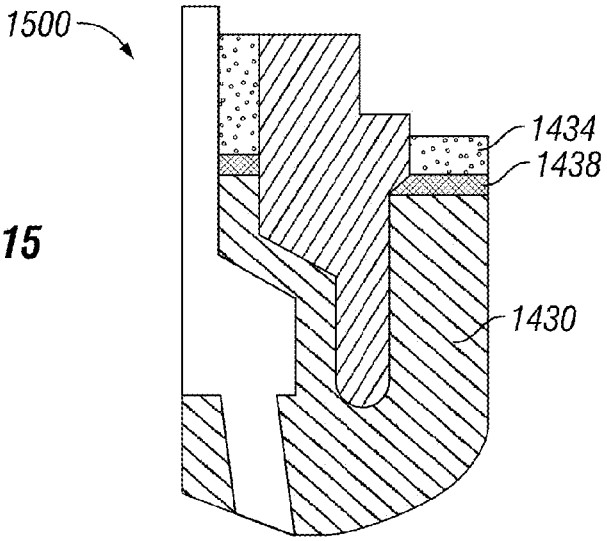
FIG. 15 shows a partial cross-sectional view of a downhole tool casting formed using the downhole tool casting assembly of FIG. 14 in accordance with the exemplary embodiment.

FIG. 15 shows a partial cross-sectional view of a downhole tool casting 1500 formed using the downhole tool casting assembly 1400 of FIG. 14 in accordance with the exemplary embodiment. The downhole tool casting 1500 is similar to downhole tool casting 1100 (FIG. 11) and/or downhole tool casting 1300 (FIG. 13) except an intermediate layer 1438 is disposed between the shoulder powder 1434 and the tungsten carbide powder 1430, as described above.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A downhole tool, comprising:

a metal component comprising a top portion, a bottom portion, and a channel extending from the top portion to the bottom portion, the metal component being fabricated from at least an iron material; and a cemented matrix material bonded to an exterior surface and an interior surface of the metal component, the cemented matrix material comprising a binder material cementing a tungsten carbide powder and a shoulder powder therein, the cemented tungsten carbide powder coupled to at least the bottom portion of the metal component and the cemented shoulder powder being coupled to at least the top portion of the metal component, the shoulder powder being positioned above the tungsten carbide powder, wherein the shoulder powder used for fabricating the downhole tool is absent any free tungsten, and wherein the shoulder powder is selected from at least one of stainless steel powder, nickel powder, cobalt powder, tantalum powder, molybdenum powder, or any other steel powder.

2. The downhole tool of claim 1, wherein the tungsten carbide powder is absent any free tungsten.

3. The downhole tool of claim 2, wherein the tungsten carbide powder is WC.

4. The downhole tool of claim 2, wherein the tungsten carbide powder is $W_2C$.

5. The downhole tool of claim 2, wherein the tungsten carbide powder is a combination of WC and $W_2C$.

6. The downhole tool of claim 1, wherein the metal component further comprises:

an internal blank component that defines the channel extending therethrough; and a coating coupled around at least a portion of the surface of the internal blank component.

7. The downhole tool of claim 6, wherein the coating comprises a metal coating.

8. The downhole tool of claim 7, wherein the metal coating is fabricated from at least one of nickel, brass, bronze, copper, aluminum, zinc, gold, a refractory transitional material, molybdenum, tantalum, carbide, boride, oxide, a metal matrix composite, and a metal alloy.

9. The downhole tool of claim 6, wherein the thickness of the coating ranges from about five micrometers to less than about 200 micrometers.

10. The downhole tool of claim 6, wherein the coating is applied onto the internal blank component using at least one of an electroplating technique, a plasma spray technique, an ion bombardment technique, and an electro-chemical depositing technique.

11. The downhole tool of claim 1, wherein the cemented matrix material further comprises the binder material cementing an intermediate layer positioned adjacently between the tungsten carbide powder and the shoulder powder, the intermediate layer comprising the tungsten carbide powder and the shoulder powder, wherein the tungsten carbide powder within the intermediate layer ranges between twenty percent to thirty percent by volume.

12. The downhole tool of claim 1, wherein the cemented matrix material further comprises the binder material cementing an intermediate layer positioned adjacently between the tungsten carbide powder and the shoulder powder, the intermediate layer comprising the tungsten carbide powder and the shoulder powder, wherein the tungsten carbide powder within the intermediate layer ranges between ten percent to less than fifty percent by volume.

13. The downhole tool of claim 2, wherein the tungsten carbide powder is selected from WC, $W_2C$, or a combination of WC and $W_2C$.

14. The downhole tool of claim 2, wherein the cemented matrix material further comprises the binder material cementing an intermediate layer positioned adjacently between the tungsten carbide powder and the shoulder powder, the intermediate layer comprising the tungsten carbide powder and the shoulder powder, wherein the tungsten carbide powder within the intermediate layer ranges between twenty percent to thirty percent by volume.

15. The downhole tool of claim 2, wherein the cemented matrix material further comprises the binder material cementing an intermediate layer positioned adjacently between the tungsten carbide powder and the shoulder powder, the intermediate layer comprising the tungsten carbide powder and the shoulder powder, wherein the tungsten carbide powder within the intermediate layer ranges between ten percent to less than fifty percent by volume.

16. A method for manufacturing a downhole tool, comprising:

placing a blank within a downhole tool casting assembly, the blank comprising a top portion, a bottom portion, and a channel extending from the top portion to the bottom portion, the blank being fabricated from at least an iron material;

placing a mixture around at least a portion of the surface of the blank within the downhole tool casting assembly, the mixture comprising a tungsten carbide powder and a shoulder powder, the tungsten carbide powder positioned adjacent at least the bottom portion of the blank and the shoulder powder being positioned adjacent to at least the top portion of the blank, the shoulder powder being positioned above the tungsten carbide powder;

melting a binder material into the mixture;

forming a cemented matrix material from the mixture and the binder material; and bonding the cemented matrix material to the blank, wherein the shoulder powder is absent any free tungsten, and wherein the shoulder powder is selected from at least one of stainless steel powder, nickel powder, cobalt powder, tantalum powder, molybdenum powder, or any other steel powder.

17. The method of claim 16, wherein the tungsten carbide powder is absent any free tungsten.

18. The method of claim 17, wherein the tungsten carbide powder is WC.

19. The method of claim 17, wherein the tungsten carbide powder is $W_2C$.

20. The method of claim 17, wherein the tungsten carbide powder is a combination of WC and $W_2C$.

21. The method of claim 16, wherein the blank further comprises:

an internal blank component that defines the channel extending therethrough; and a coating coupled around at least a portion of the surface of the internal blank component.

22. The method of claim 21, wherein the coating comprises a metal coating.

23. The method of claim 22, wherein the metal coating is fabricated from at least one of nickel, brass, bronze, copper, aluminum, zinc, gold, a refractory transitional material, molybdenum, tantalum, carbide, boride, oxide, a metal matrix composite, and a metal alloy.

24. The method of claim 21, wherein the thickness of the coating ranges from about five micrometers to less than about 200 micrometers.

25. The method of claim 21, wherein the coating is applied onto the internal blank component using at least one of an electroplating technique, a plasma spray technique, an ion bombardment technique, and an electro-chemical depositing technique.

26. The method of claim 16, wherein the mixture further comprises an intermediate layer positioned adjacently between the tungsten carbide powder and the shoulder powder, the intermediate layer comprising the tungsten carbide powder and the shoulder powder, wherein the tungsten carbide powder within the intermediate layer ranges between twenty percent to thirty percent by volume.

27. The method of claim 16, wherein the mixture further comprises an intermediate layer positioned adjacently between the tungsten carbide powder and the shoulder powder, the intermediate layer comprising the tungsten carbide powder and the shoulder powder, wherein the tungsten carbide powder within the intermediate layer ranges between ten percent to less than fifty percent by volume.

28. The method of claim 17, wherein the tungsten carbide powder is selected from WC, $W_2C$, or a combination of WC and $W_2C$.

29. The method of claim 17, wherein the mixture further comprises an intermediate layer positioned adjacently between the tungsten carbide powder and the shoulder powder, the intermediate layer comprising the tungsten carbide powder and the shoulder powder, wherein the tungsten carbide powder within the intermediate layer ranges between twenty percent to thirty percent by volume.

30. The method of claim 17, wherein the mixture further comprises an intermediate layer positioned adjacently between the tungsten carbide powder and the shoulder powder, the intermediate layer comprising the tungsten carbide powder and the shoulder powder, wherein the tungsten carbide powder within the intermediate layer ranges between ten percent to less than fifty percent by volume.

* * * * *